US008412087B2

(12) United States Patent
Condello et al.

(10) Patent No.: US 8,412,087 B2
(45) Date of Patent: Apr. 2, 2013

(54) METHODS, APPARATUS, AND SYSTEMS FOR CONTROLLING A GLOSS OF AN IMAGE FIXED BY WARM-PRESSURE FIXING

(75) Inventors: Anthony S. Condello, Webster, NY (US); Christopher Lynn, Wolcott, NY (US)

(73) Assignee: Xerox Corporation, Norwalk, CT (US)

( * ) Notice: Subject to any disclaimer, the term of this patent is extended or adjusted under 35 U.S.C. 154(b) by 283 days.

(21) Appl. No.: 12/978,997

(22) Filed: Dec. 27, 2010

(65) Prior Publication Data

US 2012/0163847 A1 Jun. 28, 2012

(51) Int. Cl.
*G03G 15/20* (2006.01)

(52) U.S. Cl. ..... 399/341; 399/331; 399/67

(58) Field of Classification Search ..... 399/331, 399/341, 67, 69, 328
See application file for complete search history.

(56) References Cited

U.S. PATENT DOCUMENTS

| | | | | |
|---|---|---|---|---|
| 5,956,555 | A | 9/1999 | Chen et al. | |
| 8,270,889 | B2 * | 9/2012 | Sambhy et al. | 399/333 |
| 2012/0039648 | A1 * | 2/2012 | Sambhy et al. | 399/333 |

OTHER PUBLICATIONS

Dale R. Mashtare; "Multi-Stage Fixing Systems, Printing Apparatuses and Methods of Fixing Marking Material to Substrates"; U.S. Appl. No. 12/855,011, filed Aug. 12, 2010.

* cited by examiner

*Primary Examiner* — David Gray
*Assistant Examiner* — G. M. Hyder
(74) *Attorney, Agent, or Firm* — Ronald E. Prass, Jr.; Prass LLP

(57) ABSTRACT

A fixed image gloss control system outputs a warm pressure-fixed image having a low gloss level. The image is alterable to change the low gloss level to a high gloss level or an intermediate gloss level. The fixing system includes a pressure roll and a fixing roll that together form a fixing nip. The pressure roll has a polyurethane contact surface. A polishing mechanism may polish the fused image to achieve a desired gloss level.

19 Claims, 4 Drawing Sheets

METHODS, APPARATUS, AND SYSTEMS FOR CONTROLLING A GLOSS OF AN IMAGE FIXED BY WARM-PRESSURE FIXING

RELATED APPLICATIONS

This application is related to U.S. patent application Ser. No. 12/855,011, entitled MULTI-STAGE FIXING SYSTEMS, PRINTING APPARATUSES AND METHODS OF FIXING MARKING MATERIAL TO SUBSTRATES, the entire disclosure of which is incorporated by reference herein in its entirety.

FIELD OF DISCLOSURE

The disclosure relates to methods, apparatus, and systems for controlling a gloss of images fixed by warm-pressure fixing systems.

BACKGROUND

Related art fixing systems typically do not accommodate control over a gloss level of a particular printed image. In related art fixing systems that fuse or fix marking material, e.g., toner, to a substrate such as a paper web to form a toner image, parameters such as fusing surface, oil rate, and toner are constants. A fixing temperature may be adjusted to ensure that the toner image is adequately fixed to the surface of a substrate, but altering the fixing temperature does not provide control over a gloss level of the fixed toner image.

SUMMARY

Methods, apparatus, and systems that permit control over a gloss level of a fused or fixed image are disclosed. A desired gloss level may depend on image content and a gloss level of a media or substrate to which the image is fixed. Generally, high gloss may be desirable for, e.g., color or pictorial prints. Matte paper and text documents may look more appealing with low gloss. The methods, apparatus, and systems disclosed herein accommodate control over a gloss level of a printed image, e.g., toner fixed to a substrate by warm-pressure fixing.

In embodiments, a fixing system for contact-fixing marking material to a substrate may include a fixing member and a pressure member. The pressure member may include a contact layer made of polyurethane. Polyurethane is a durable elastomer that is advantageous for its relatively high modulus of elasticity and temperature resistance. Other materials, such as heavily loaded silicones, viton or the like could also be envisioned. The contact layer contacts the image and/or substrate during fixing. The fixing member and pressure member may be arranged to define a fixing nip. The fixing member and pressure member are operable to apply warm-pressure fixing conditions to fuse or fix a marking material to a substrate, such as a paper web, as the substrate passes through the nip.

Warm-pressure fixing conditions may include a pressure at the nip of about 300 psi to about 1,200 psi. For example, the pressure at the fixing nip may be 700 psi during fusing. A fusing nip temperature may be about 80 degrees Celsius to about 140 degrees Celsius. In embodiments, a pressure member having a polyurethane contact surface may be used to produce a fixed image having a low gloss level, e.g., less than 4 ggu. The fixed image with low gloss level is alterable, and may be polished, rubbed, or burnished to achieve a desired level of gloss with substantially no offset of marking material on polishing system components.

In embodiments, methods include producing a fixed image with a low gloss by fixing marking material to a substrate under warm-pressure fixing conditions using a pressure member with a polyurethane contact layer. In further embodiments, methods include applying a polishing mechanism to the low gloss fixed image to modify the gloss level and achieve a desired level of gloss. A polishing system may be located in-line, downstream of the fixing nip. The polishing system may be applied to the fixed low gloss image to achieve desired gloss levels, e.g., greater than about 2 ggu and up to about 100 ggu, without offsetting on component(s) of the polishing system.

A low gloss image that has been fixed under warm-pressure conditions, i.e., moderate to high pressure and low temperature, by a fixing assembly having a pressure member contact layer in accordance with exemplary embodiments may be burnished, i.e., may be burnished to alter the gloss level. Specifically, the fixed image may be polished to alter the level of gloss from a low gloss, e.g., 2 ggu, to a high gloss, e.g., about 100 ggu, or levels there between. This may be done without offsetting marking material on components of the polishing system.

Accordingly, methods, apparatus, and systems disclosed herein accommodate production of fixed low gloss images that may be modified by a downstream and/or inline polishing system, or burnishing device, to produce high or in-between gloss levels. The foregoing exemplary gloss values and ranges apply to toner, and may be shifted for various marking materials, e.g., higher nominal melting toner. Other marking materials that maybe used in accordance with exemplary embodiments may include Magnetic toner, Solid ink, liquid ink, and gel ink.

Exemplary embodiments are described herein. It is envisioned, however, that any system that incorporates features of methods, apparatus, and systems described herein are encompassed by the scope and spirit of the exemplary embodiments.

DETAILED DESCRIPTION

Figure 1:
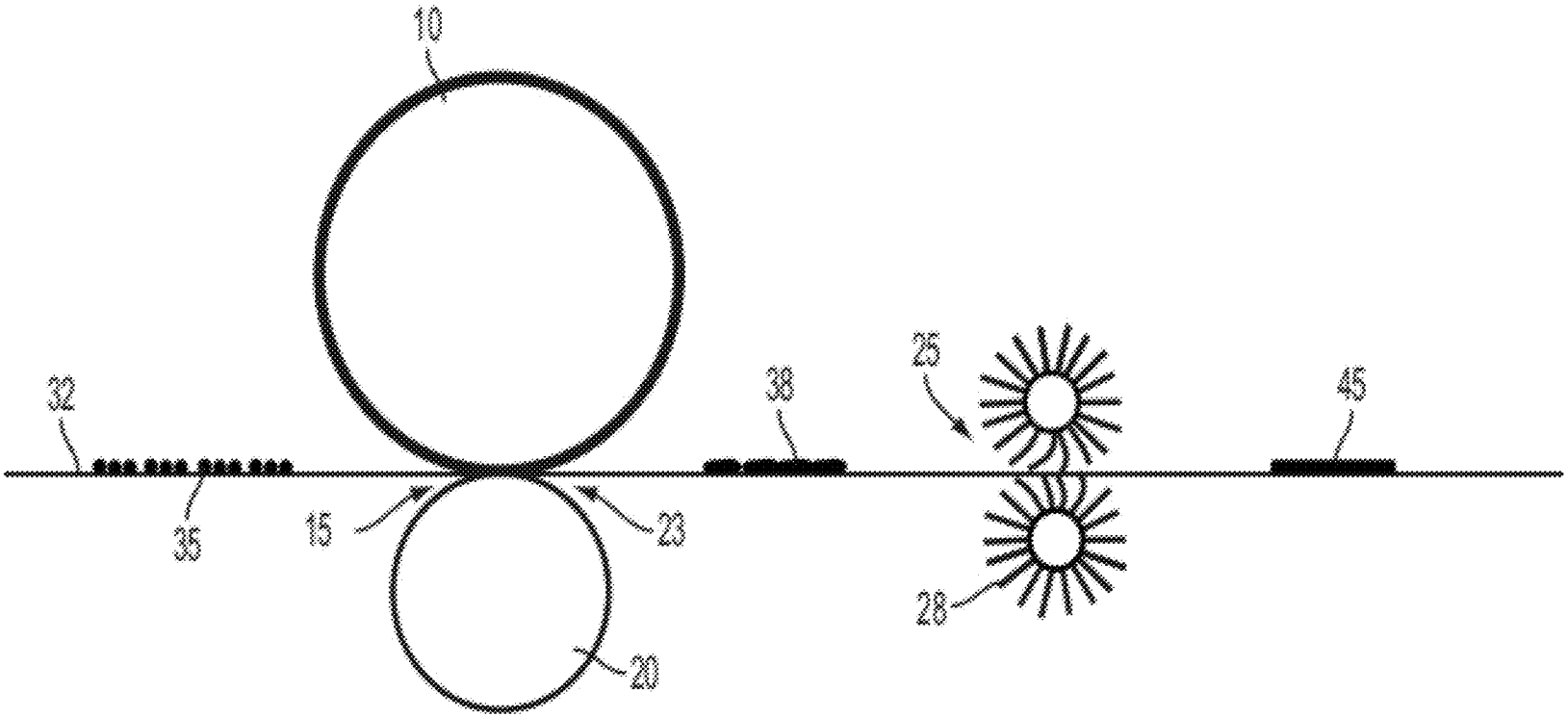
FIG. 1 shows a diagrammatical side view of a gloss control system and polishing system in accordance with an exemplary embodiment.

Exemplary embodiments are intended to cover all alternatives, modifications, and equivalents as may be included within the spirit and scope of the methods, apparatus, and systems as described herein.

Reference is made to the drawings to accommodate understanding of methods, apparatus, and systems for controlling gloss or selecting a gloss level of a marking material image fixed to a substrate by warm-pressure fixing using a pressure member with a polyurethane contact surface. In the drawings, like reference numerals are used throughout to designate similar or identical elements. The drawings depict various embodiments and data related to embodiments of illustrative methods, apparatus, and systems for controlling gloss levels of fused or fixed images.

Apparatus and systems of embodiments may include systems for printing images on substrates by fixing to the substrates marking material such as toner, or solid ink used in ink jet printing systems, by warm-pressure fixing. Exemplary methods and devices for fixing marking material, e.g., toner, to a substrate using warm-pressure fixing are disclosed in FIXING DEVICES INCLUDING EXTENDED-LIFE COMPONENTS AND METHODS OF FIXING MARKING MATERIAL TO SUBSTRATES, the entire disclosure of which is incorporated by reference herein in its entirety, MULTI-STAGE FIXING SYSTEMS, PRINTING APPARATUSES AND METHODS OF FIXING MARKING MATERIAL TO SUBSTRATES, the entire disclosure of which is incorporated by reference herein in its entirety, and FIXING DEVICES FOR FIXING MARKING MATERIAL TO A WEB WITH CONTACT PRE-HEATING OF WEB AND MARKING MATERIAL AND METHODS OF FIXING MARKING MATERIAL TO A WEB, the entire disclosure of which is incorporated by reference herein in its entirety.

Apparatus and systems of embodiments may include a translatable member such as a belt that carries a substrate marked with toner deposited thereon to a fixing nip where the substrate and marking material may be warm-pressure fixed. Specifically, the substrate and marking material are subject to low temperature, moderate to high pressure conditions to fix the marking material to the substrate. Alternatively, embodiments may include a paper web that translates through the fixing nip with marking material deposited thereon.

In alternative embodiments, marking material may be deposited directly onto a surface of the fixing member. For example, the fixing member may include a surface comprising, e.g., anodized aluminum. The marking material, e.g., ink, may be deposited on the aluminum surface, and translated to the fixing nip. In solid ink jet systems, for example, an anodized fuser member and a pressure member having a polyurethane surface may define a nip at which jetted ink is transfixed to paper in one step. In further alternative embodiments, the marking material may be a solid ink that is softened before arriving at the fusing nip.

The fixing system may include a fixing member and a pressure member. The fixing member and/or the pressure member may be heated, and the fixing member and the pressure member may be operable to apply warm-pressure fixing conditions at the fixing nip. A thermal energy source for heating the fixing member and/or pressure member may be included. The fixing member and the pressure member together form a fusing nip. At the fixing nip, the fixing member and the pressure member may be operable to apply heat and pressure to the substrate and unfixed marking material to fix the marking material to the substrate.

In embodiments, the pressure member may include a contact surface that contacts a substrate during fixing. The contact surface may include a layer formed of polyurethane, or a similar material. Similar materials may include any highly durable elastomer such as Silicone, Viton, NBR, or the like. An image fixed by a pressure member having a polyurethane contact surface may exit the fixing nip with a low gloss level. Further, the fixed image can be modified to alter the gloss level. In further embodiments, a polishing system may be used to modify the low gloss image by polishing the image to produce an image having a high gloss level or an intermediate gloss level.

FIG. 1 shows a fixing device in accordance with an exemplary embodiment. The fixing device includes a fixing roll 10. In embodiments, the fixing roll 10 may be, e.g., a drum having a surface made of porous anodized aluminum (aluminum oxide, $Al_2O_3$). The surface of the fixing roll 10 may comprise a metallic material, a ceramic material, or a composite material. In other embodiments, the fixing roll 10 may include a surface comprising polyurethane, nitrile butadiene rubber, or the like. The fixing roll 10 may be rotatable, and may be heated by a heat source. In alternative embodiments, the fixing member may be a belt, or may be constructed to carry a marking material through a fixing nip for transfixing the marking material to a substrate.

A fixing nip 15 may be formed by the fixing roll 10 and a pressure roll 20. The pressure roll 20 may comprise a core and an outer surface including polyurethane. For fixing, the nip or an outer surface of the fixing roll 10 may be heated to a temperature suitable for fixing the toner formulation to the substrate 32. In embodiments, a fixing temperature may be set from about 50° C. to about 140° C., such as about 90° C. to about 140° C., or about 105° C. to about 130° C., for fixing toner on the substrate 32. In embodiments, the pressure roll 20 may be heated. Increasing the pressure applied at the fixing nip can allow a lower fixing temperature to be used. In embodiments, a temperature and pressure may be adjusted for different substrate materials and types, and different marking materials and types.

In embodiments, an amount of pressure applied to the substrate 32 during fixing may be about 300 psi to about 3000 psi, such as about 300 psi to about 1500 psi, or about 400 psi to about 1000 psi. For example, the pressure may be about 300 psi to about 800 psi. In embodiments, a pressure at the fixing nip 15 may be about 400 psi to about 1000 psi, and the fixing temperature may be about 90 degrees Celsius to about 140 degrees Celsius. In alternative embodiments, the pressure at the fixing nip 15 may be about 400 psi to about 700 psi, and the fixing temperature may be about 90 degrees Celsius to about 140 degrees Celsius. In further alternative embodiments, the pressure at the fixing may be about 400 psi to about 700 psi, and the fixing temperature may be about 105 degrees Celsius to about 130 degrees Celsius.

A polishing mechanism may comprise a first buffer roll 25 and a second buffer roll 28. The polishing mechanism may be located in-line, downstream of the fixing nip 15. In alternative embodiments, the polishing mechanism may include in single roll, or more than two rolls. Instead of rolls, the polishing mechanism may comprise pads, brushes . . . , or other member suitable for burnishing or rubbing a low gloss fixed image output from the fixing nip 15. Other polishing mechanisms of embodiments may include spinning woven or non-woven cloth, individual fiber brush, continuous polishing web, etc.

A translatable member carrying a substrate, or a web substrate, e.g., a paper web, may be implemented. For example, substrate 32 may be arranged to carry a marking material deposited on the substrate 32 through the fixing nip 15 and then, optionally, to the polishing rolls 25 and 28 for polishing. A marking material such as toner 35 may be deposited on the substrate 32, and carried to the fixing nip 15. In embodiments, the substrate 32 may be, e.g., a paper web that is translated through the fixing nip 15. At the fixing nip 15, the marking material is fixed to the substrate 32 by warm-pressure fixing.

In accordance with embodiments, the marking material 38 is fixed to the substrate to form an image having a low gloss level. For example, the image may have a gloss level of 3 ggu or less, e.g, 2 ggu. Optionally, the fixed image may be polished using a polishing mechanisms such as the first and/or second polishing rolls 25 and 28. The polishing mechanism may be applied to the fixed image to burnish, rub, or polish the fixed marking material 38. The polished fixed image includes a polished fixed marking material 45, and has a gloss level that is higher than the gloss level of the unpolished fixed image produced in accordance with exemplary embodiments.

Embodiments of methods include fixing marking material to a substrate by warm-pressure fixing using a fixing system having a pressure member with a polyurethane contact surface. Fixed images produced by these methods and systems exhibit a low gloss level and minimal offset. Embodiments may further include a polishing system or mechanism that may be used to rub or burnish the fused image until a desired gloss level is achieved. A length of time and/or an amount of force applied to the fixed low gloss image by the polishing system may be varied according to a desired gloss level.

Accordingly, a polishing system of embodiments may accommodate control over a level of gloss for toner printed images fixed by a WPF process. In particular, polishing systems disclosed herein may be used in combination with a fixing system that implements a pressure roll having a polyurethane coated surface.

Figure 2A:
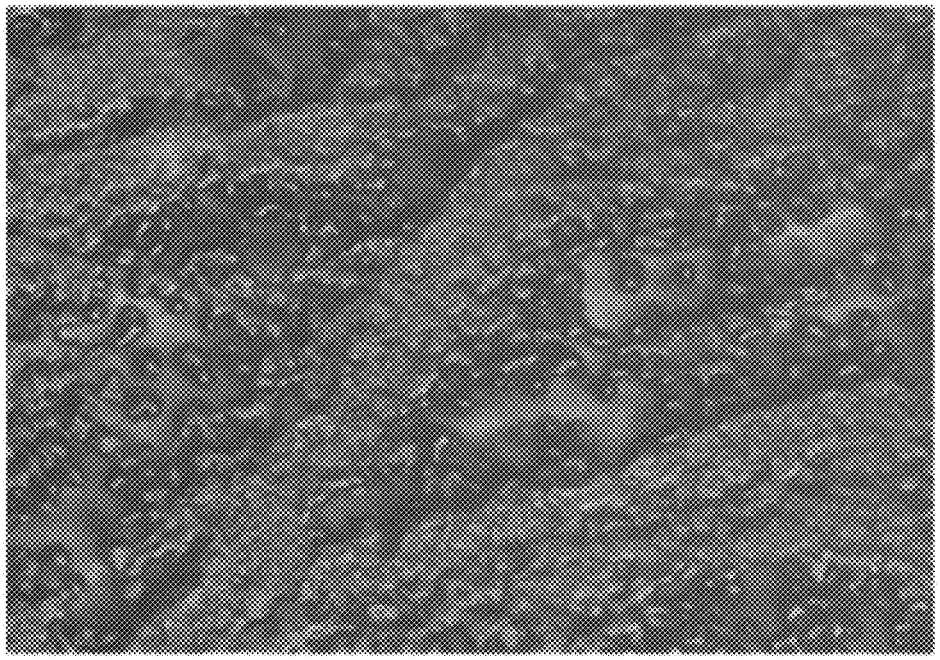
FIG. 2A shows a photograph of an expanded view of a fixed toner image fixed by related art systems.
Figure 2B:
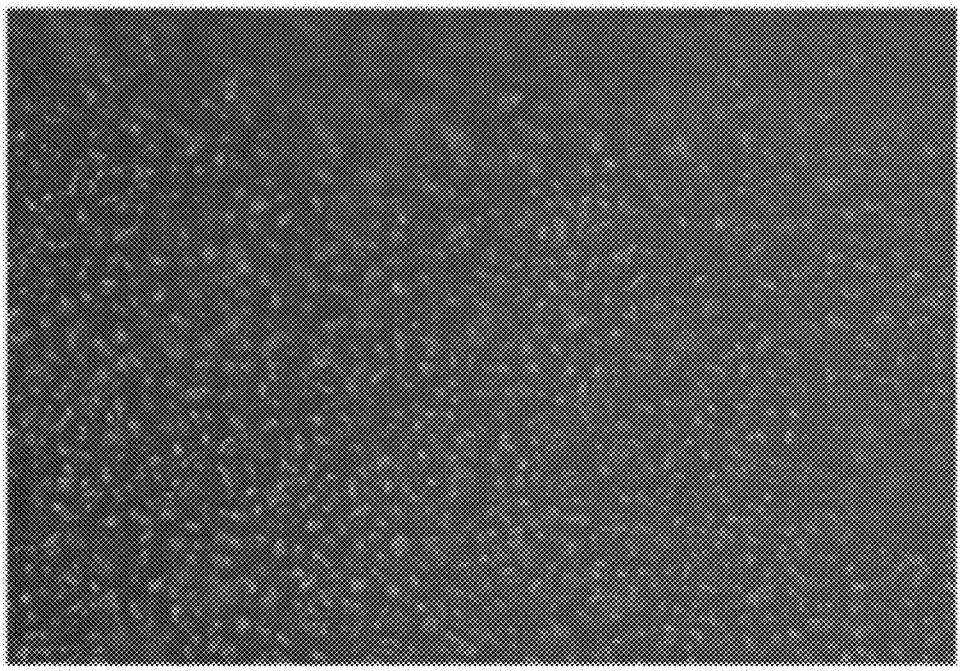
FIG. 2B shows a photograph of an expanded view of a low gloss fixed toner image fixed by methods and systems in accordance with an exemplary embodiment.
Figure 2C:
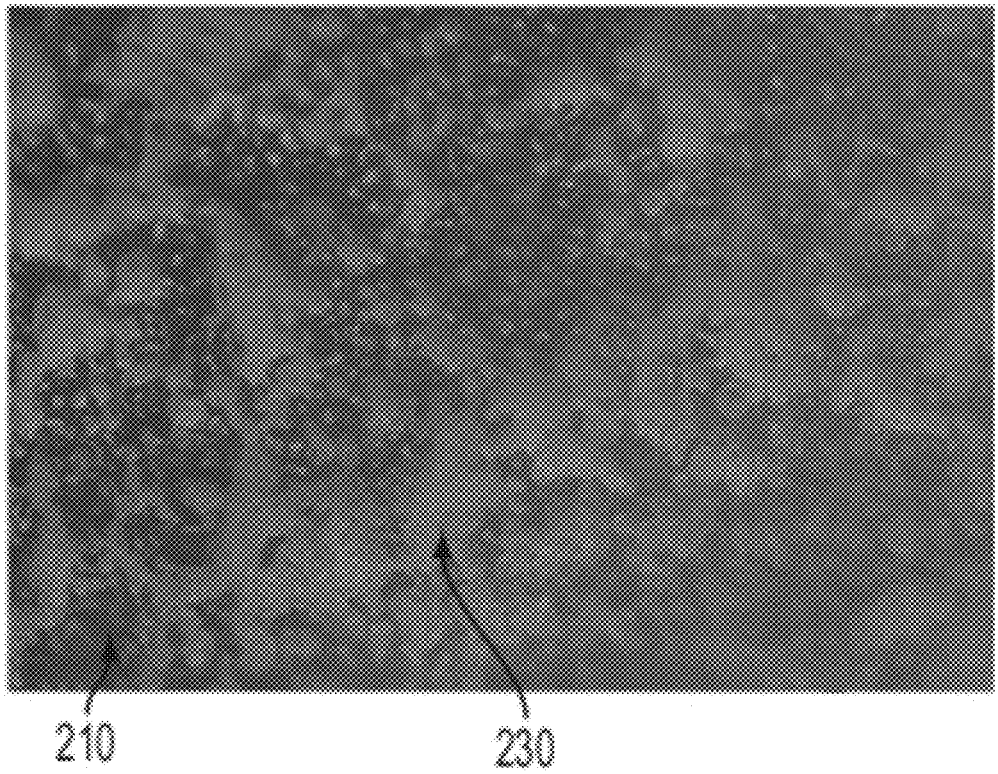
FIG. 2C shows a photograph of an expanded view of a high gloss fixed toner image fixed by methods and systems in accordance with an exemplary embodiment.

FIGS. 2A-2C show images of enlarged views of fixed toner on a paper substrate. Specifically, FIG. 2A shows an enlarged view of a surface of a paper substrate having a fixed black and white toner image. The image was produced and fixed by related art methods, apparatus, and systems. The gloss level of the depicted toner image is about 5 ggu to about 15 ggu, and the image cannot be polished to produce an altered level of gloss while maintaining image integrity.

The images of FIGS. 2B-2C were printed in accordance with exemplary methods, apparatus, and systems disclosed herein for comparison with the image printed by related art methods, apparatus and systems of FIG. 2A. Specifically, FIG. 2B shows an enlarged view of a toner image fixed to a surface of a paper substrate by warm-pressure fixing. The image has a matte finish, and a low gloss level of about 2 ggu. The image may be polished to produce a level of gloss that is greater than, e.g., about 2 ggu up to about 30 ggu.

FIG. 2C shows an enlarged view of an image produced by methods, apparatus, and systems that were substantially the same as those used to produce the image of FIG. 2B. The fixing system included no belt, a fuser member and a pressure member. The pressure member included a urethane surface. The fixing member included an anodized surface.

Fixing was carried out under warm-pressure conditions. The temperature of the pressure member was 120 degrees Celsius, and the temperature of the fixing member was 100 degrees Celsius. The pressure applied at the fixing nip was 700 psi. The nip width was 5.2 mm, and the dwell time was 2 ms. A step of preheating was not implemented.

The gloss level achieved by related art methods, apparatus, and systems as shown in FIG. 2A is typically between 5 ggu and 15 ggu. Related art systems do not accommodate controlling the gloss of a fixed image. The image output from the fusing nip of related art systems has a final gloss in the range noted immediately above, and is cannot be polished to alter the gloss to a high level or an intermediate level.

Methods, apparatus, and systems in accordance with embodiments described herein employ a pressure member having an outer contact surface containing urethane or the like during warm-pressure fixing to produce advantageous low gloss images that are polishable. Images fixed accordingly exhibit a low gloss of about 2 ggu, as shown in FIG. 2B. Advantageously, the output images exhibiting low gloss may be polished, rubbed, or buffed to alter the gloss level. For example, the buffed image shown in FIG. 2C exhibits a higher level of gloss, i.e., 25 ggu, after being softly buffed with cotton.

While methods, apparatus, and systems for controlling gloss of print images fixed by warm-pressure fixing are described in relationship to exemplary embodiments, many alternatives, modifications, and variations would be apparent to those skilled in the art. Accordingly, embodiments of the methods, apparatus, and systems as set forth herein are intended to be illustrative, not limiting. There are changes that may be made without departing from the spirit and scope of the exemplary embodiments.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art.

What is claimed is:

1. A method for controlling gloss of a marking material image fixed to a substrate by a fixing system having a fixing member and a pressure member, the fixing member and the pressure member defining a fixing nip through which a substrate having unfixed marking material may be translated for fixing, the pressure member having a contact surface comprising polyurethane, the method comprising:

receiving a substrate having unfused marking material at the fixing nip;

fixing the marking material to the substrate, wherein the fixing comprises contacting the substrate with the contact surface of the pressure member to produce a polishable fixed image.

2. The method of claim 1, the fixing further comprising applying a temperature of about 80 degrees Celsius to about 120 degrees Celsius at the fixing nip.

3. The method of claim 1, further comprising heating at least one of the fixing member and the pressure member.

4. The method of claim 3, the heating comprising heating to a temperature of about 80 degrees Celsius to about 120 degrees Celsius.

5. The method of claim 3, the fixing further comprising applying a pressure at the fixing nip of about 300 to about 800 psi.

6. The method of claim 3, the fixing further comprising applying a pressure of about 700 psi at the fixing nip.

7. The method of claim 1, the method further comprising outputting from the fixing nip a polishable fixed image having a low gloss level of less than about 3 ggu.

8. The method of claim 1, the method further comprising outputting from the fixing nip a polishable fixed image having a low gloss level of about 2 ggu.

9. The method of claim 1, a polishing system being located downstream of the fixing nip, the method further comprising:

polishing the fixed image to produce an image having a high gloss or intermediate gloss of greater than about 2 ggu and equal to or less than about 30 ggu.

10. The method of claim 1, wherein the fixing comprises heating the fixing member to a temperature of about 100 degrees Celsius.

11. The method of claim 1, wherein the fixing comprises heating a pressure member to a temperature of about 120 degrees Celsius.

12. A fixed image gloss control apparatus, comprising:

a fixing system configured to fix a marking material to a substrate, the fixing system having a fixing member and a pressure member that define a fixing nip, the pressure member having a contact surface comprising polyurethane that contacts the substrate during fixing to output a polishable, low gloss fixed image.

13. The apparatus of claim 12, the fixing nip having fixing temperature of about 80 degrees Celsius to about 120 degrees Celsius.

14. The apparatus of claim 12, the fixing nip having a fixing pressure of about 300 psi to about 800 psi.

15. The apparatus of claim 14, wherein the pressure is applied by the pressure member.

16. The apparatus of claim 12, at least one of the fixing member and the pressure member being heated to a temperature of about 80 degrees Celsius to about 120 degrees Celsius.

17. The apparatus of claim 12, the fixing system being located upstream of a polishing system for optionally polishing the fixed image to produce a desired gloss level.

18. The apparatus of claim 17, the polishing system comprising at least one roll for contacting the fixed image.

19. A fixed image gloss level control system, comprising:

a fixing means for fixing a marking material to a substrate to produce a low gloss fixed image on the substrate; and a polishing means that optionally polishes the fixed image to a desired gloss level.

* * * * *